United States Patent [19]

Mullen et al.

[11] Patent Number: 4,507,272

[45] Date of Patent: Mar. 26, 1985

[54] METHOD OF PURIFYING PARTIALLY CARBONIZED PAN MATERIAL PRIOR TO CARBONIZATION

[75] Inventors: Charles K. Mullen, Anaheim; Gary D. Shepherd, Redondo Beach; Ramon B. Fernandez, Torrance; Kenneth B. Bergren, Hawthorne, all of Calif.

[73] Assignee: Hitco, Newport Beach, Calif.

[21] Appl. No.: 493,075

[22] Filed: May 9, 1983

[51] Int. Cl.[3] ..... D01F 9/22

[52] U.S. Cl. ..... 423/447.4; 264/29.2; 423/447.2; 423/447.6; 423/449

[58] Field of Search ..... 423/447.4, 447.6, 447.2, 423/449, 447.1; 264/29.2; 8/115.5

[56] References Cited

U.S. PATENT DOCUMENTS 3,413,094 11/1968 Gibson ..... 423/447.2

4,073,869 2/1978 Kalnin ..... 423/447.1

4,388,289 6/1983 Shepherd et al. ..... 423/447.4

*Primary Examiner*—Edward J. Meros

*Attorney, Agent, or Firm*—Fraser and Bogucki

[57] ABSTRACT

In a method of producing purified carbonized material from polyacrylonitrile precursor material, the precursor material is initially oxidized and partially carbonized prior to purification treatment to remove alkali and alkaline earth metal impurities. Following purification, the material is substantially completely carbonized. Purification is accomplished by weaving oxidized and partially carbonized tows of the polyacrylonitrile precursor material into a fabric and thereafter contacting the fabric with an aqueous acid solution at an elevated temperature followed by rinsing with a solvent which is substantially free of alkali and alkaline earth metal ions and which is at an elevated temperature. Purification of the tows after partial carbonization thereof limits the amount of tow weight loss and shrinkage occurring after the fabric is formed.

8 Claims, 2 Drawing Figures

METHOD OF PURIFYING PARTIALLY CARBONIZED PAN MATERIAL PRIOR TO CARBONIZATION

BACKGROUND OF THE INVENTION

1. Field of the Invention

The present invention relates to methods of removing impurities from carbonaceous materials, and more particularly to methods of removing sodium, potassium and other alkali and alkaline earth metals from PAN materials.

2. History of the Prior Art

It is known in the art to provide products made from carbonaceous materials in various forms such as fibers which have been woven into a fabric and carbonized. For certain applications such as ablative components on aerospace vehicles and the like, such products in addition to being carbonized should have high temperature thermal stability, low thermal conductivity and low concentration of alkali and alkaline earth impurities (low ionization potential materials) to reduce the electron concentrations in the boundary layer and thereby the attenuation of vehicle communication which results therefrom. For such applications alkali and alkaline earth metals must be considered impurities, and as such are desirably removed from the carbonaceous material as completely as possible. The removal of alkali and alkaline earth metal impurities also significantly increases the oxidation resistance of such materials so as to enhance their usefulness in high temperature material applications.

There are various ways of producing carbonaceous materials having the desirable low content of alkali and alkaline earth metal impurities. One way is to heat the material within the graphitization temperature range. This has proven to be undesirable in that while it volatilizes and thereby eliminates most or all of the alkali impurities, it also leaves the material with a crystalline structure of a graphitic nature such that the thermal conductivity thereof is unacceptably high. Another approach is to make the carbonaceous product from precursor material which itself has a very low alkali and alkaline earth metal content. However, such precursor materials are very expensive to produce and are not found among standard commercially available materials. A third approach, which is the one most often used for economical reasons, is to treat the carbonaceous material at some stage in the processing thereof prior to carbonization to remove a substantial portion of the alkali and alkaline earth metal impurities. This enables the material to be subsequently carbonized at low enough temperatures so as not to adversely affect the crystalline structure and thereby the thermal conductivity of the final product while at the same time providing a relatively pure product of substantial carbon composition.

U.S. Pat. No. 3,413,094 of Gibson, issued Nov. 26, 1968 and assigned to the assignee of this application, provides one example of a method of treating fibrous carbonaceous materials so as to eliminate alkali and alkaline earth metal impurities. The methods of the Gibson patent involve dipping material which has been carbonized in an aqueous solution of hydrobromic acid or hydroiodic acid and thereafter firing the treated products at a temperature sufficient to remove substantial metallic impurities but below a temperature sufficient to substantially increase thermal conductivity and crystallinity of the product. Following the acid dip, the material is full of alkali and alkaline earth metal impurities, and the extra firing step is required in order to eliminate such impurities. However, the extra firing step increases the chance of crystallization of the material and resulting higher thermal conductivity in the finished product.

The methods of the Gibson patent were developed in conjunction with the widespread use of cellulosic precursor materials such as rayon, and such methods are unsatisfactory when used with materials of polyacrylonitrile origin. This appears to be due in part to the distribution and chemical bonding of alkali and alkaline earth metal ions throughout the thickness of the fibers in the case of polyacrylonitrile material. Such impurities in materials of cellulosic origin are not an intrinsic chemical part of the fibers and are therefore relatively easily removed by various washing and scrubbing techniques.

The availability of polyacrylonitrile precursor materials in recent years and the resulting popularity thereof in terms of low cost and other factors have created a need for a method of purification capable of reducing the total alkali and alkaline earth metal content of carbonized material to levels on the order of 30 parts per million or less.

It is generally known that certain types of carbonaceous materials can be purified to some extent by washing in acids, detergents, or even pure water. An example of a treatment involving washing with both detergent and acid is provided by U.S. Pat. No. 3,179,605 of Ohsol, issued Apr. 20, 1965. The Ohsol patent is concerned with purification of regenerated cellulosic fibers for purposes of enhancing their general properties such as tensile strength rather than alkali and alkaline earth metal impurity. This is done by washing the fibers in a non-ionic detergent, then rinsing in water, then washing in an aqueous acid solution, then rinsing in water, then drying, and finally carbonizing the fibers.

The Ohsol patent is typical of prior art methods of treatment which are complex and which do not produce acceptable levels of final purity for ablative applications even when used to purify materials of cellulosic origin. When such methods are used to process carbonaceous material of other than cellulosic origin such as materials made from polyacrylonitrile precursors, the resultant laundering of some surface impurities and little else has little effect on the total impurity content. While the patent discusses purity levels on the order of 10–25 parts per million of sodium in conjunction with its cellulosic precursor material, the total alkali and alkaline earth metals content is much larger and becomes even higher as the material is carbonized.

U.S. Pat. No. 2,950,253 of Kling et al. provides a further example of a washing or laundering process for removing surface impurities. Kling et al disclose a variety of different chemicals for cleaning soiled fabric.

U.S. Pat. No. 4,079,446 of Horikiri et al. which is of interest with respect to acid treatment of materials addresses the problem of the instability of polyethylene at high temperatures. Polyethylene is very difficult to form into a fiber and readily loses fiber integrity upon heating. In order to overcome this obstacle in forming a carbon fiber out of polyethylene fiber, the polyethylene is treated with an acid to preserve fiber integrity. The acid is such that it sulfonates the fiber. Accordingly, Horikiri et al do not deal with the removal of alkali and alkaline earth metals from fibers such as polyacrylonitrile but instead address the specific problem of the poor integrity of polyethylene fibers at high temperatures and the fact that such integrity can be improved by sulfonating the fiber through interaction with an acid.

A further patent which is of interest with respect to acid treatment of materials is U.S. Pat. No. 4,113,847 of Fukishima et al. The Fukushima et al patent relates to a process for making acrylonitrile precursor material in which a spun mixture of fibers including acrylonitrile is washed and then stretched in hot acid water having a pH below a specified level. Thus this patent relates to the production of PAN precursor having good filament separability, no breakage of single filaments and few fluffs and little disorder of filaments, and not to the purification of PAN material which has already been produced.

U.S. Pat. No. 2,932,550 of Walmsley is of interest for its disclosure of the treatment of PAN material with an acid. However, such treatment has nothing to do with purification and instead is performed to create dye sites. Thereafter, a dye chemically combines with the PAN material, which is the desired result. The PAN material is immersed in sodium carbonate, reinforcing the fact that Walmsley is not concerned with the presence of sodium or other alkali or alkaline earth metals.

U.S. Pat. No. 3,412,062 of Johnson et al. and U.S. Pat. No. 3,532,466 of Johnson et al. are of interest in describing conventional processes for carbonizing polyacrylonitrile material.

Other developments of interest in this area include that shown by U.S. Pat. No. 4,073,869 of Kalnin in which material of at least 90% carbon composition is treated with a strong acid to add oxygen to the chemical change and thereby reduce thermal and electrical conductivities, the acid having a concentration of at least about 65% and preferably on the order of 100%. Japanese Pat. No. 49-109633 describes the use of nitric acid to set a polymer during spinning. Japanese Pat. No. 48-42812 describes treatment of carbonized or graphitized fibers with acid to increase porosity and surface area and enhance strength. Japanese Pat. No. 49-26195 describes the use of acid to set fibers during spinning so as to produce a fiber for cation exchange processes. Four different articles by Takahashi in "Chemical Abstracts", Vol. 64, 1966, 8367b-c, 12, 862b-c describe various treatments of flame-proofed PAN material including heat treatment, moisture sorption, stability upon exposure to chemicals including weak and strong acids and the effects of acid treatment on tensile strength.

An example of a method of purifying PAN-based material which advances over the methods previously discussed is provided by a co-pending application of Gary D. Shepherd et al., Ser. No. 140,257, filed Apr. 14, 1980, now U.S. Pat. No. 4,388,289, and commonly assigned with the present application. The Shepherd et al application describes a method of removing alkali and alkaline earth metal impurities from PAN material which has been oxidized but not carbonized to any extent. The purification method involves contacting the oxidized PAN material with an aqueous acid solution at an elevated temperature followed by rinsing with a solvent that is substantially free of alkali and alkaline earth metal ions.

At the time that the process described in the Shepherd et al application was developed, it was known that PAN material which had already been carbonized was virtually impossible to purify from a practical standpoint. Carbonization appears to seal in the alkali and alkaline earth metal impurities to such an extent that the material must be heated to a temperature on the order of 1600° C. or greater to achieve the desired levels of purity. High temperatures on that order result in unacceptably high thermal conductivity for ablative applications of the material. It was therefor assumed that purification had to take place before any carbonization of the material was begun.

In the purification method described in the Shepherd et al application the PAN material which has been oxidized is first woven into a fabric before being contacted with the aqueous acid solution and rinsed with a solvent. Formation of a fabric of the PAN material is necessary if the material is to be purified in an economical fashion. The fabric is continuously advanced through the various cells of a tank containing the aqueous acid solution. Following exposure to the aqueous acid solution, the fabric is slowly advanced through a rinse tank containing the solvent and is then dried. Following drying, the purified fabric is carbonized by being advanced through a carbonization furnace heated to an appropriate carbonization temperature for a period of several minutes or longer to provide a product of substantially carbon composition.

Following oxidation the PAN material which is typically in the form of a plurality of tows is woven into a fabric as noted above. This not only facilitates purification of the PAN material but it also provides a fabric of essentially carbon composition when carbonization has been completed. Unfortunately carbonization of the oxidized and purified tows results in a weight loss in the tows of up to 50% and a shrinkage in the tows of about 25–30%. Consequently, at the end of carbonization the fabric is of a generally porous, sleazy nature and lacks the structural integrity desired for use or further processing of the fabric.

Accordingly, it would be desirable to provide an improved method of producing purified carbonacious material from polyacrylonitrile precursor material. In particular it would be advantageous to provide a method of producing purified carbonaceous material in which weight loss and shrinkage of the individual tows comprising a fabric as a result of carbonization of the fabric is reduced so as to provide a fabric of substantially carbon composition which is of relatively low porosity and otherwise has relatively good structural integrity.

BRIEF DESCRIPTION OF THE INVENTION

These and other objects are accomplished in accordance with the invention by providing an improved method in which PAN precursor material which has been oxidized is partially carbonized prior to purification of the material. The oxidized PAN material is subjected to a precarbonization process in which it is heated in an inert atmosphere to temperatures within the range of 460°–650° C. for several minutes. Following precarbonization, the material is woven into a fabric and is thereafter purified by contacting with an aqueous acid solution followed by rinsing in a solvent substantially free of impurities being removed and then drying. Following drying, the fabric is carbonized by heating to a temperature on the order of 1070° C. for at least about a minute.

Precarbonization of the material is accompanied by a weight loss of approximately 25% and shrinkage of approximately 10–15%. Because weaving of the fabric takes place after the occurrence of this weight loss, the weight loss of the tows comprising the fabric upon carbonization is limited to no more than about 25%. Similarly, shrinkage of the tows upon carbonization is limited to about 10%. Consequently, the carbonized fabric is relatively dense and nonporous and has substantial structural integrity.

In a preferred method of purifying partially carbonized PAN material in accordance with the invention, PAN precursor tows are oxidized by being advanced through four successive stages in an oxidizing oven where the tows are heated in air. The tows are heated at 235° C. for 25 minutes in a first stage, then at 245° C. for 20 minutes in a second stage, then at 248° C. for 20 minutes in a third stage, and finally at 249° C. for 25 minutes in a fourth stage. Following oxidation the tows are precarbonized by being advanced under tension through a precarbonization furnace where the tows are heated in an inert atmosphere. The tows are heated at 460° C. for 1 minute and then at 650° C. for 1 minute. Precarbonization typically produces about a 25% weight loss and about 10–15% shrinkage in the tows as well as contributing substantially to the structural integrity of the tows.

Following precarbonization, the tows are woven into a fabric having a relatively dense, tight weave. The fabric is continuously advanced through a tank where it is contacted with an aqueous acid solution containing a small amount of a nonionic surfactant or other wetting agent. In one example the aqueous acid solution is comprised of 17% by weight hydrochloric acid and 0.2% by weight of a nonionic surfactant. The solution is maintained at 212° F., and contacting of the fabric occurs for 3 hours. Following contact with the aqueous acid solution, the fabric is rinsed in a solvent such as deionized water which is relatively free of alkali and alkaline earth metal ions. Rinsing in deionized water is at 160° F. for 40 minutes. Following rinsing the fabric is dried in order to complete the purification process.

The purified fabric is then carbonized by being passed through a furnace at 1070° C. for 1 minute. Such carbonization results in no more than about 25% weight loss and no more than about 10% shrinkage in the tows such that the end product comprises a fabric of substantial carbon composition having relatively low porosity and relatively high structural integrity.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
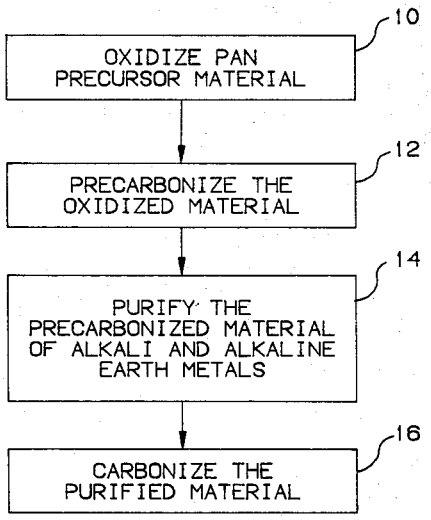
FIG. 1 depicts in generalized fashion the successive steps in a method of producing purified carbonized material from polyacrylonitrile precursor material in accordance with the invention.

FIG. 1 depicts the successive steps in a method of producing purified carbonized material from polyacrylonitrile precursor material in accordance with the invention. In a first such step 10 raw or precursor polyacrylonitrile (PAN) material is oxidized. The term "oxidized" is used herein in accordance with its well-known meaning in the art to describe any of the various processes which can be used to effect the substantial stabilization of polyacrylonitrile material such that substantially complete cyclization of the nitrile material occurs. Typically the PAN material is heated in air within an oxidizing oven to a selected temperature or temperatures for selected residence times. In the case of elongated tows of PAN material, the tows are preferably continuously advanced through the oxidizing oven as part of a continuous process.

Following the oxidization step 10, the oxidized PAN material is precarbonized in a second step 12. In the case where elongated tows are continuously advanced through an oxidizing oven during the oxidizing step 10, the tows are fed from the exit end of the oxidizing oven into a precarbonization furnace where the tows are heated in an inert atmosphere such as nitrogen to temperatures in the general range of 460°–650° C. The tows are continuously advanced through the precarbonization furnace at a speed which provides a total residence time within the furnace sufficient to produce partial but not complete carbonization of the tows. A typical residence time for tows being heated in the 460°–650° C. range is about 2 minutes. Precarbonization of the tows results in some weight loss thereof which is typically on the order of about 25%. The weight loss is accompanied by shrinkage of the tows on the order of 10–15% which places the tows in tension in the case where the tows are continuously advanced through the precarbonization furnace using typical equipment therefor. The resulting precarbonized tows have substantially improved structural integrity when compared with the properties of the tows following oxidation and prior to precarbonization.

In a next step 14 the oxidized and precarbonized PAN material is purified by removing most of the alkali and alkaline earth metals therefrom. As described in the previously referred to co-pending application of Shepherd et al, relatively large amounts of alkali and alkaline earth metals such as sodium and potassium are introduced during polymerization of acrylonitrile in the formation of polyacrylonitrile material. The alkali and alkaline earth metals are chemically linked with and form a part of the polyacrylonitrile material and are not simply surface impurities. Consequently alkali and alkaline earth metals cannot be removed by simply washing or by utilizing the various processes of the prior art designed for purification of materials other than PAN such as of cellulosic origin where the impurities tend to reside at the surface of the material and in any event are not an intrinsic chemical part of the material.

As described in the Shepherd et al. application alkali and alkaline earth metals can be removed from polyacrylonitrile material by providing a chemical interaction in the form of an exchange of alkali and alkaline earth metal ions with an acid. For example, if hydrochloric acid (HCl) is used, then the hydrogen in the acid replaces the sodium or potassium which combines with the chloride of the acid to form salt (NaCl). Because the alkali and alkaline earth metal ions permeate the entire thickness of the PAN material rather than simply residing at the surface, it is essential for a solution of the acid to penetrate all or substantially all of the thickness of the material if substantial removal of such ions is to be achieved. However, the nature of PAN fibers is such that they do not readily wet and therefore resist penetration by the acid solution to the inner core to a substantially greater extent than penetration of the surface thereof. The desired penetration may be achieved by contacting the PAN material with an aqueous acid solution which has been heated above room temperature. Addition of a wetting agent such as a nonionic surfactant to the aqueous acid solution may be necessary or desirable in some cases.

The ion exchange is carried out by contacting the PAN fibers with the aqueous acid solution, such as by placing the acid solution in a container and immersing the fibers in the acid solution. Virtually any acid can be used so long as it forms alkali and alkaline earth metal salts which are soluble so that they can be dissolved and removed during subsequent rinsing of the PAN fibers. Acids such as hydrochloric and sulfuric and perhaps hydrobromic are preferred because they are relatively inexpensive and are soluble in and form salts which are readily soluble in various solvents such as deionized water.

Purification of the PAN material is usually enhanced by treating the material in such a way that there is at least occasional and preferably generally continuous motion of the aqueous acid solution over the surface of the PAN fibers. This can be accomplished by using a standard processing tank of the type in which the contents of the tank are removed, heated in a heat exchanger, and then returned to the tank. The continuous circulation of aqueous acid solution when stored in such a tank causes the acid solution to continually flow over the surfaces of the fibers, producing the desired relative motion. Such motion may be further enhanced by moving the fibers through the tank in the form of a woven fabric drawn from a roll and alternating between opposite rollers at the top and bottom of the tank. By driving the rollers so as to advance the fabric in various passes through the tank at a relatively slow, constant speed in well-known fashion, every part of the fabric is disposed within the aqueous acid solution for the desired residence time.

Accordingly, as a first operation within the purification step 14, the oxidized PAN tows produced by the step 12 are woven into a fabric which can then be advanced through the tank containing the recirculating aqueous acid solution. Following contacting of the tows with the aqueous acid solution, the fabric can be fed into a separate rinsing tank where it is rinsed with an appropriate solvent such as deionized water which is substantially free of alkali and alkaline earth metal ions and in which the acid and its salts are soluble. The PAN fibers are not truly free of impurities until the salts formed by the ion exchange between the acid and the alkali and alkaline earth metals are dissolved in and removed by the solvent together with residual acid. The solvent is preferably maintained at an elevated temperature and may be sprayed on as well as circulated past the tows to enhance the rinsing process. Spraying the tows with the solvent also creates motion between the heated solvent and the fibers which is desirable. Following rinsing of the fibers, the fibers are preferably dried so as to remove substantially all of the residual solvent therefrom prior to further processing of the fibers. Steam cans are effectively used for this purpose.

Following drying the purification operation of step 14 is completed and the purified fabric is ready for carbonization as shown by a fourth and final step 16 in FIG. 1. Carbonization is accomplished by heating the fabric in an inert atmosphere such as nitrogen to an appropriate carbonization temperature for an appropriate residence time. A temperature on the order of 1070° C. and a residence time of about 1 minute have been found to produce a desirable amount of carbonization of the tows within the fabric without raising the thermal conductivity of the fabric to an unacceptable level for ablative applications. In the case of a continuous process, the fabric which has been dried as it is fed from the rinse tank during the purification step 14 is continuously fed through a carbonization furnace at a speed which provides the desired residence time within the furnace.

Figure 2:
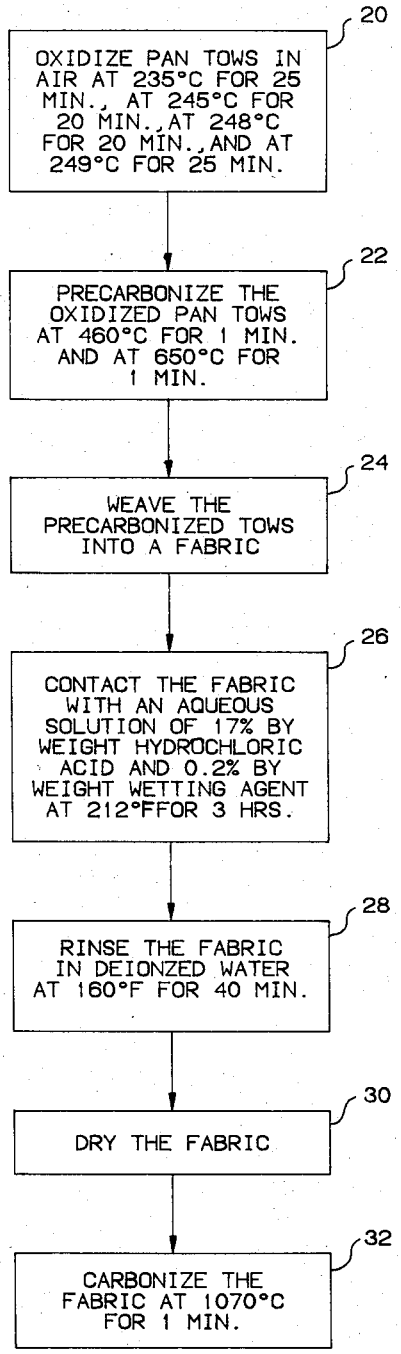
FIG. 2 depicts the successive steps in a detailed example of a method of producing purified carbonized fabric from PAN tows in accordance with the invention.

FIG. 2 depicts a detailed example of a method of purifying partially carbonized PAN material in accordance with the invention. The starting material in the example of FIG. 2 comprised 600 tows of Mitsubishi 3K carbonizable grade polyacrylonitrile. The "3K" designation indicates that each tow is comprised of approximately 3000 PAN filaments. The 600 tows were drawn from individual creels into a fill yarn inserter of the type shown in U.S. Pat. No. 4,173,990 of Spain et al., which issued on Nov. 13, 1979 and which is commonly assigned with the present application. The fill yarn inserter forms the tows into a web by interweaving a fill yarn with the various tows in order to hold the tows together for purposes of further processing.

From the fill yarn inserter the tows of the web so formed were drawn through a tension stand into an oxidizing oven having four separate stages therein and designed so that the tows continuously move through the four different stages in succession. Oxidation of the tows comprises a first step 20 shown in FIG. 2. Within the first stage of the oxidizing oven the tows were exposed to air at 235° C. for 25 minutes. Within the second stage the tows were exposed to air at 245° C. for 20 minutes. Within the third stage the tows were exposed to air at 248° C. for 20 minutes. Within the fourth and final stage the tows were exposed to air at 249° C. for 25 minutes.

At the output of the fourth stage of the oxidizing oven the tows had a specific gravity of 1.37 which provides a measure of the degree of oxidization. A specific gravity on the order of 1.42 or greater following oxidation usually signals an overoxidized condition. A specific gravity below about 1.34 on the other hand denotes underoxidation which will typically result in exotherming of the tows during carbonization thereof. A tension stand at the output of the oxidizing oven combines with the tension stand at the input thereto to maintain a desired amount of tension within the tows as they are continuously advanced through the oxidizing oven.

In a second step 22 shown in FIG. 2 the oxidized web of tows was precarbonized by advancing the web from the output of the oxidizing oven through a precarbonization furnace having an inert nitrogen atmosphere therein. The precarbonization furnace was comprised of three different stages, the first of which was heated to 460° C. and the second of which was heated to 650° C. Advancement of the tows through the precarbonization furnace was at a speed providing a residence time of 1 minute in each of first and second stages. The third stage of the furnace was not heated and provided cooling down of the tows prior to exiting the precarbonization furnace. Upon exiting the precarboniztion furnace, the fill yarn previously inserted by the fill yarn inserter at the entrance to the oxidizing oven was removed so as to separate the 600 tows of the web from each other. The tows had a specific gravity of 1.62 following precarbonization.

In a next step 24 shown in FIG. 2 the precarbonized tows were woven into a 24×24 count 8 harness satin fabric having a width of 36". Such fabric has a relatively high density and a resulting relatively low porosity.

In a next step 26 the fabric formed by the step 24 was contacted with an aqueous solution of 17% by weight hydrochloric acid (HCl) and 0.2% by weight of a wetting agent at 212° F. for 3 hours. This was accomplished by advancing the fabric through a tank having seven different cells arranged to provide a continuous countercurrent of the acid solution relative to the fabric in addition to external heating and continuous recirculation of the acid solution. The residence time of 3 hours was chosen to insure thorough penetration and purification of the tows, and in many cases a residence time of considerably less than 3 hours should produce acceptable results. As previously noted acids other than HCl can be used. Acid concentration depends upon the type of acid and the residence time and can also vary. The wetting agent used in this example consisted of a nonionic surfactant in the form of Triton X100 which is manufactured by Rohm & Haas and which consists of isooctylthenoxytolyethoxyethanol. Other wetting agents can be used including other nonionic surfactants and other compounds of a different nature. The wetting agent is important, at least in the present example, in providing the necessary amount of penetration of the partially carbonized PAN fibers which are hydrophobic in nature by the aqueous acid solution.

Following the step 26 and in a next step 28 in the method of FIG. 2 the fabric was rinsed in deionized water at 160° F. for 40 minutes. Deionized water comprises one example of a solvent which is substantially free of alkali and alkaline earth metal ions and which can therefore be used to remove the formed salts and the residual acid from the PAN fibers. The rinsing operation in the present example was conducted within a 7 cell tank similar to that used for the contacting of the fabric with the aqueous acid solution. The deionized water was maintained at or relatively close to 160° F. The fabric was immersed in and continuously moved through the deionized water. At the exit end of the rinse tank deionized water being introduced into the supply thereof contained within the tank was sprayed onto the fabric to provide a final cleansing action as well as agitation and movement of the deionized water relative to the fabric. Movement of the fabric through the rinse tank was at a speed which provided a residence time of about 40 minutes. It is likely that a shorter residence time which would result from a faster speed or a smaller tank or both would produce satisfactory rinsing in most instances.

As the fabric was drawn from the rinse tank, it was dried using steam cans as represented by a next step 30 in the method of FIG. 2. The drying step 30 removes the solvent and the residual acid from the fabric.

Following drying the fabric was carbonized in a following and final step 32 by being advanced through a resistance heating carbonization furnace where the fabric was exposed to a temperature of 1070° C. in a nitrogen atmosphere for 1 minute. The fabric at the exit end of the carbonization furnace was of substantially carbon composition. Also, because of the reduced amount of weight loss and shrinkage which occur during carbonization because of the use of precarbonization, the fabric remained rather substantial from a structural standpoint and porosity therein was kept to a controlled low level. Strength of the fabric in both the warp and fill directions was significantly better than in cases where all of the carbonization was done following weaving and purification.

PAN material which was processed in accordance with the method of FIG. 2 was measured for purity after the weaving step 24 and again at the end of the carbonization step 32. The results of such measurements given in parts per million (ppm) are as follows:

| | FABRIC WHICH WAS OXIDIZED AND PRECARBONIZED BUT NOT YET PURIFIED | | FABRIC WHICH WAS PURIFIED AND CARBONIZED | |
|---|---|---|---|---|
| | Leading End | Trailing End | Leading End | Trailing End |
| Na | 442 | 467 | 12 | 10 |
| K | 5 | 11 | 0 | 0 |
| Ca | 8 | 7 | 0 | 0 |
| Mg | 4 | 7 | 1 | 2 |
| Li | 0 | 0 | 0 | 0 |
| Total | 459 ppm | 492 ppm | 13 ppm | 12 ppm |

In each case the fabric was tested for purity at both the leading end thereof and the trailing end thereof to determine any variation therebetween. As was suspected the fabric was slightly purer at the leading end than at the trailing end in most instances. The above table shows that total purity levels of 459 ppm and 492 ppm after precarbonization and prior to purification were reduced to 13 ppm and 12 ppm respectively following purification and carbonization. Sodium (Na) which is the predominant impurity was reduced from 442 ppm and 467 ppm prior to purification to 12 ppm and 10 ppm respectively following purification and carbonization.

While the invention has been particularly shown and described with reference to a preferred embodiment thereof, it will be understood by those skilled in the art that various changes in form and details may be made therein without departing from the spirit and scope of the invention.

What is claimed is:

1. A method of producing purified carbonized material from oxidized polyacrylonitrile precursor material comprising the steps of:

providing a quantity of oxidized polyacrylonitrile precursor material;

partially carbonizing the oxidized polyacrylonitrile precursor material to provide partially carbonized material;

treating the partially carbonized material to remove alkali and alkaline earth metal impurities therefrom and provide purified material and including the steps of contacting the partially carbonized material with an aqueous acid solution and thereafter rinsing the partially carbonized material with a solvent which is substantially free of alkali and alkaline earth metal ions, and processing the purified material to provide substantially complete carbonization thereof;

the step of partially carbonizing the oxidized material comprising heating the oxidized material to 460°-650° C., and the step of processing the purified material to provide substantially complete carbonization thereof comprising heating the purified material to a temperature of at least about 1000° C.

2. The invention set forth in claim 1, wherein the aqueous acid solution contains a wetting agent and is maintained at a temperature not substantially less than about 212° F. and the solvent is maintained at a temperature not substantially less than about 160° F.

3. The invention set forth in claim 2, further including the step of drying the partially carbonized material following rinsing of the material with the solvent.

4. A method of producing purified carbonized fibers from fibers of polyacrylonitrile precursor material comprising the steps of:

providing fibers of polyacrylonitrile precursor material;

passing the fibers through an oxidizing oven to oxidize the fibers;

passing the oxidized fibers through a precarbonization furnace to partially carbonize the fibers;

weaving the partially carbonized fibers into a fabric;

treating the fabric to remove alkali and alkaline earth metal impurities therefrom comprising contacting the fabric with an aqueous acid solution at an elevated temperature and thereafter rinsing the fabric; and thereafter passing the fabric through a carbonization furnace to substantially completely carbonize the fabric;

the step of passing the oxidized fibers through a precarbonization furnace to partially carbonize the fibers comprising passing the oxidized fibers through a first section of a precarbonization furnace heated to about 460° C. for about 1 minute and through a second section of the precarbonization furnace heated to about 650° C. for about 1 minute, and the step of passing the fabric through a carbonization furnace to substantially completely carbonize the fabric comprising passing the fabric through a carbonization furnace at a temperature of about 1070° C. for about 1 minute.

5. The invention set forth in claim 4, wherein the aqueous acid solution has a temperature of about 212° F. and the rinsing of the fabric is done with a solvent which is substantially free of alkali and alkaline earth metal ions and which has a temperature of about 160° F.

6. The invention set forth in claim 5, wherein the fabric is contacted with the aqueous acid solution for about 3 hours, the aqueous acid solution has an acid concentration of about 17% by weight, the solvent comprises deionized water, and the fabric is rinsed in the deionized water for about 40 minutes.

7. The invention set forth in claim 6, wherein the aqueous acid solution comprises an aqueous solution of hydrochloric acid containing a surfactant, the surfactant having a concentration of about 0.20% by weight.

8. The invention set forth in claim 4, wherein the step of passing the fibers through an oxidizing oven to oxidize the fibers comprises heating the fibers at about 235° C. for about 25 minutes, then at about 245° C. for about 20 minutes, then at about 248° C. for about 20 minutes and then at about 249° C. for about 25 minutes.

* * * * *